US006979422B2

(12) United States Patent
Parkin et al.

(10) Patent No.: US 6,979,422 B2
(45) Date of Patent: Dec. 27, 2005

(54) ACTIVE FLASHBACK ARRESTOR FOR USE WITH HEAD OF A TORCH

(75) Inventors: Nigel Parkin, Florence, SC (US); John Onorato, Bixby, OK (US); Paul Mercuri, Florence, SC (US)

(73) Assignee: The ESAB Group, Inc., Florence, SC (US)

( * ) Notice: Subject to any disclaimer, the term of this patent is extended or adjusted under 35 U.S.C. 154(b) by 71 days.

(21) Appl. No.: 10/368,168

(22) Filed: Feb. 18, 2003

(65) Prior Publication Data

US 2004/0161719 A1 Aug. 19, 2004

(51) Int. Cl.[7] ..... B23K 7/00
(52) U.S. Cl. ..... 266/48; 431/347
(58) Field of Search ..... 266/48; 431/346, 431/347, 328

(56) References Cited

U.S. PATENT DOCUMENTS

| | | | |
|---|---|---|---|
| 1,097,263 | A | 5/1914 | Reich |
| 1,114,706 | A | 10/1914 | Brousseau |
| 1,139,959 | A | 5/1915 | Fausek et al. |
| 1,176,017 | A | 3/1916 | Armstrong |
| 1,228,038 | A | 5/1917 | Marlin |
| 1,290,422 | A | 1/1919 | Vale et al. |
| 1,439,861 | A | 12/1922 | Brown et al. |
| 1,729,206 | A | 9/1929 | Coberly |
| 1,955,120 | A | 4/1934 | Fausek et al. |
| 2,391,592 | A | 12/1945 | Pierson |
| 2,482,457 | A | 9/1949 | Boedecker |
| 2,810,631 | A | 10/1957 | Kanenbley |
| 2,974,723 | A | 3/1961 | Blanchard |
| 3,182,334 | A | 5/1965 | Hammon |
| 3,192,987 | A | 7/1965 | Hammon |
| 3,243,272 | A | 3/1966 | Schmitz |
| 3,746,500 | A | 7/1973 | Hughey |
| 3,866,839 | A | 2/1975 | Magner |
| 3,933,444 | A | 1/1976 | Kilgore |
| 4,022,441 | A | 5/1977 | Turney |
| 4,184,931 | A | 1/1980 | Inoue |
| 4,248,384 | A | 2/1981 | Zwicker |
| 4,251,226 | A | 2/1981 | Nishikawa |
| 4,286,620 | A | 9/1981 | Turney |
| 4,361,420 | A | 11/1982 | Bell |
| 4,409,002 | A | 10/1983 | Zwicker |
| 4,431,167 | A | 2/1984 | Clarke |
| 4,548,358 | A | 10/1985 | Fischer |
| 4,566,676 | A | 1/1986 | Lotz |
| 4,585,409 | A | 4/1986 | Pryor |
| 4,664,621 | A | 5/1987 | Sugisaku et al. |
| 4,732,559 | A | 3/1988 | Pearl, II et al. |
| 4,846,670 | A | 7/1989 | Pearl, II et al. |

(Continued)

FOREIGN PATENT DOCUMENTS

DE 25 12 947 A1 10/1976

(Continued)

OTHER PUBLICATIONS

Parkin et al., U.S. Appl. No. 09/939,850; filed Aug. 27, 2001; entitled *Flashback Arrestor For Use With Head of Oxy-Fuel Torch.*

*Primary Examiner*—Scott Kastler
(74) *Attorney, Agent, or Firm*—Alston & Bird LLP

(57) ABSTRACT

Flashback protection is provided proximate the head of a cutting torch by a fitting, which can be in the form of an adapter or a cutting tip for mounting to the head. The fitting includes a check valve and porous structure for restricting flashback.

24 Claims, 8 Drawing Sheets

U.S. PATENT DOCUMENTS

| | | | | |
|---|---|---|---|---|
| 4,923,394 | A | 5/1990 | Fumino | |
| 5,392,825 | A | 2/1995 | Mims et al. | |
| 5,407,348 | A | 4/1995 | Mims et al. | |
| 5,470,227 | A | 11/1995 | Mims et al. | |
| 5,560,546 | A | 10/1996 | Goulet et al. | |
| 5,688,469 | A | 11/1997 | Edenfield | |
| 5,769,119 | A | 6/1998 | Edenfield | |
| 5,792,281 | A | 8/1998 | Diehl | |
| 5,799,878 | A | 9/1998 | Görde et al. | |
| 6,726,471 | B2 * | 4/2004 | Parkin et al. | 431/346 |

FOREIGN PATENT DOCUMENTS

| | | |
|---|---|---|
| GB | 2 181 530 A | 4/1987 |
| WO | WO 94 16270 A1 | 7/1994 |
| WO | WO 95 01533 A1 | 1/1995 |

* cited by examiner

ACTIVE FLASHBACK ARRESTOR FOR USE WITH HEAD OF A TORCH

FIELD OF THE INVENTION

The present invention relates to cutting torches and, more particularly, to cutting torches with flashback arrestors.

BACKGROUND OF THE INVENTION

Oxy-fuel cutting torches discharge fuel gas and oxygen from a nozzle for cutting purposes. A typical torch includes a control body for being connected to separate fuel gas and oxygen supplies, tubes for supplying the oxygen and fuel gas from the control body to a head, and a cutting tip mounted to the head. The cutting tip receives the fuel gas and oxygen from the head and discharges these gases from its nozzle. More specifically, the head includes an interior surface extending around and defining a head cavity, an oxygen port that is open to the head cavity for supplying oxygen to the head cavity, and a fuel gas port that is open to the head cavity for supplying fuel gas to the head cavity. The cutting tip includes multiple passageways for directing the gases from the head to the nozzle.

Conventional torches first generate a preheat flame with gases discharged from the nozzle, and the preheat flame is used to heat a metal workpiece. After the preheat flame has heated the workpiece sufficiently, a high velocity cutting oxygen stream is activated and delivered through the nozzle. The high velocity cutting oxygen stream physically removes molten material of the workpiece by oxidation, to cut the workpiece. Typically, a number of valves and related components are provided upstream of the nozzle, such as in the control body, to control the operations of the cutting torch.

Flashback is a reaction caused in cutting torches by the reverse flow and ignition of the explosive mixture of gases used in the operation of the torch. Flashback typically originates at the nozzle of the torch and is often caused by an obstruction at this point, operator error, and/or improper gas pressure. Due to the rapid and explosive nature of flashback, it poses a potential hazard to the operator of the gas torch and can damage the gas torch and associated equipment. Accordingly, and as disclosed in WO 94/16270, it is known to include sintered metal in a gas torch nozzle in an effort to control flashback. Similarly, and as disclosed in U.S. Pat. No. 1,114,706, it is known to have a valve within an upper part of a gas torch nozzle in an effort to control flashback.

Although it is known to control flashback near its source, it is believed that there is a need in the art for an improved flashback arrestor that is proximate the head of a cutting torch for restricting flashback into the head, and which provides an improved balance of properties.

SUMMARY OF THE INVENTION

In accordance with one aspect of the present invention, flashback protection is provided proximate the head of a cutting torch by a fitting, which is preferably in the form of an adapter or a cutting tip for mounting to the head. More specifically in accordance with this aspect, the fitting is for being mounted to a head of a cutting torch for receiving at least fuel from the head and restricting flashback.

In accordance with one aspect of the present invention, a fitting includes a fuel passageway for receiving fuel from the head and discharging the fuel, and a valve plug that is preferably movably positioned in the fuel passageway for moving from an open position to a closed position in response to reverse flow in the fuel passageway, so as to restrict flashback from passing through the fuel passageway. In accordance with one embodiment, the valve plug includes a pathway, a portion of the valve plug extends completely around the pathway, the pathway is open while the valve plug is in the open position, and the pathway is closed while the valve plug is in the closed position, so as to restrict flashback from passing through the pathway.

In accordance with one aspect of the present invention, a fitting includes a fuel passageway for receiving fuel from the head and discharging the fuel, and the fitting further includes both a porous structure and a valve plug for restricting flashback. Preferably the porous structure and the valve plug are positioned in the fuel passageway for restricting flashback from passing through the fuel passageway. In accordance with one embodiment of the present invention, the porous structure is preferably positioned so as to function as a stop against which the valve plug abuts while the valve plug is in the open position.

In accordance with one aspect of the present invention, the fitting can be readily used and replaced in a manner that is likely to ensure optimum functionality. In accordance with this aspect, the check valve and/or porous structure of the fitting are carried by a body of the fitting in a manner that promotes the disposal of the used fitting rather than just the replacement of the valve plug and/or porous structure of the fitting, which promotes safe operation of cutting torches by inhibiting end users from improperly installing the valve plug and/or porous structure. Alternatively, the valve plug and/or porous structure can be readily removable from the fitting and are replaceable.

In accordance with one aspect of the present invention, an end of the fitting is inserted into the cavity of the head of the cutting torch when mounting the fitting to the head, the end of the fitting is withdrawn from the cavity when unmounting the fitting from the head, and the valve plug and/or porous structure are associated with the fitting so that the valve plug and/or porous structure restrict flashback from entering the fuel port of the head while the fitting is mounted to the head. In addition, the fitting carries the valve plug and/or porous structure so that the valve plug and/or porous structure move with the fitting when the fitting is moved from being completely separate from the head to being mounted to the head, and when the fitting is being moved from being mounted to the head to being completely separate from the head. As a result, the fitting can be easily initially installed and replaced with minimal risk of the valve plug and/or porous structure being incorrectly installed and thereby failing to perform their intended function. Preferably the valve plug and/or porous structure are positioned in the fuel passageway to restrict flashback from passing through the fuel passageway.

In accordance with one aspect of the present invention, the fitting further includes an oxygen passageway for receiving oxygen from the head of the torch and discharging the oxygen from the fitting, and the fuel passageway includes an annular space that extends around the oxygen passageway, with the valve plug and/or porous structure preferably being positioned in the annular space, which is most preferably an annular internal chamber. In accordance with one embodiment of the present invention, a first part of the fitting is mounted to a second part of the fitting so that surfaces of these parts together define the chamber that contains the valve plug and/or porous structure. In one example, this advantageously seeks to render the fitting tamper resistant and thereby enhance the disposable aspect of the fitting. That is, and in addition to the fitting being constructed so as to minimize the risk of the valve plug and/or porous structure being incorrectly installed, in accordance with the present aspect a user will preferably be unaware of the possibility of disassembling the fitting to replace the valve plug and/or porous structure should they become clogged, which will advantageously minimize the possibility of a user incorrectly installing a replacement valve plug and/or porous structure within the fitting. Alternatively, the valve plug and/or porous structure can be readily removable from the fitting and are replaceable.

It is accordingly one aspect of the present invention to promote safe use of a cutting torch by suppressing flashback proximate its source through the use of a fitting that is substantially foolproof, such as, for example, by being disposable.

BRIEF DESCRIPTION OF THE DRAWINGS

Figure 1:
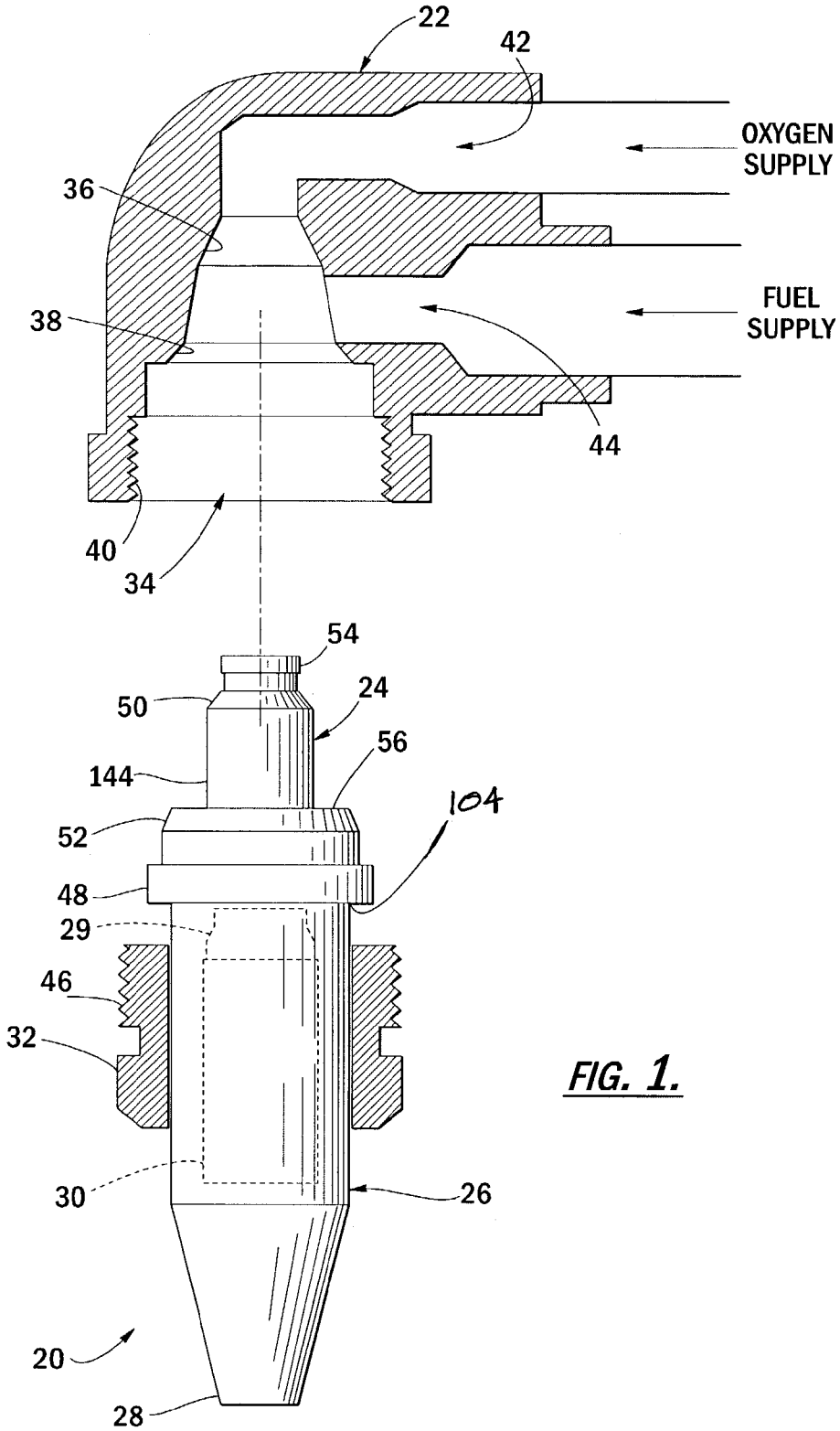
Figure 2:
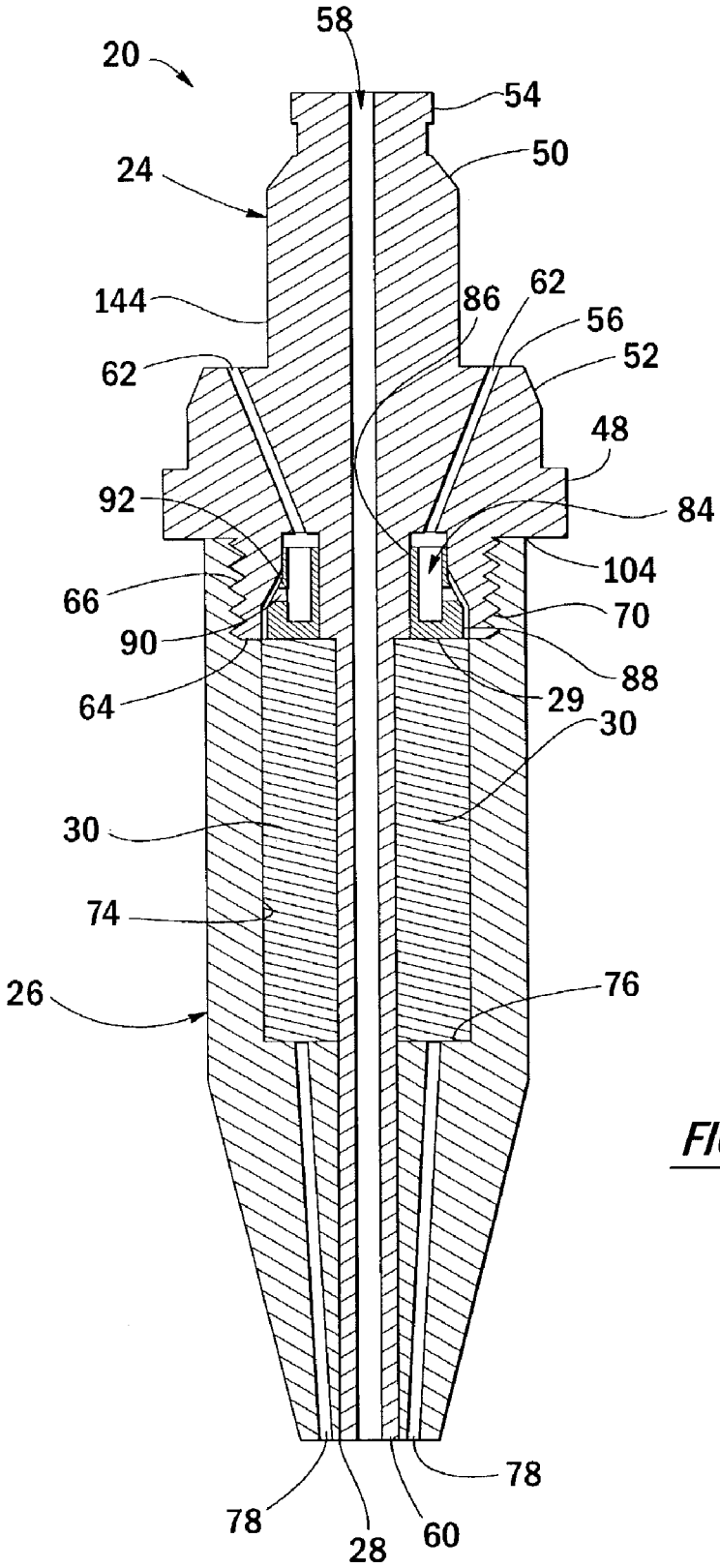
Figure 3:
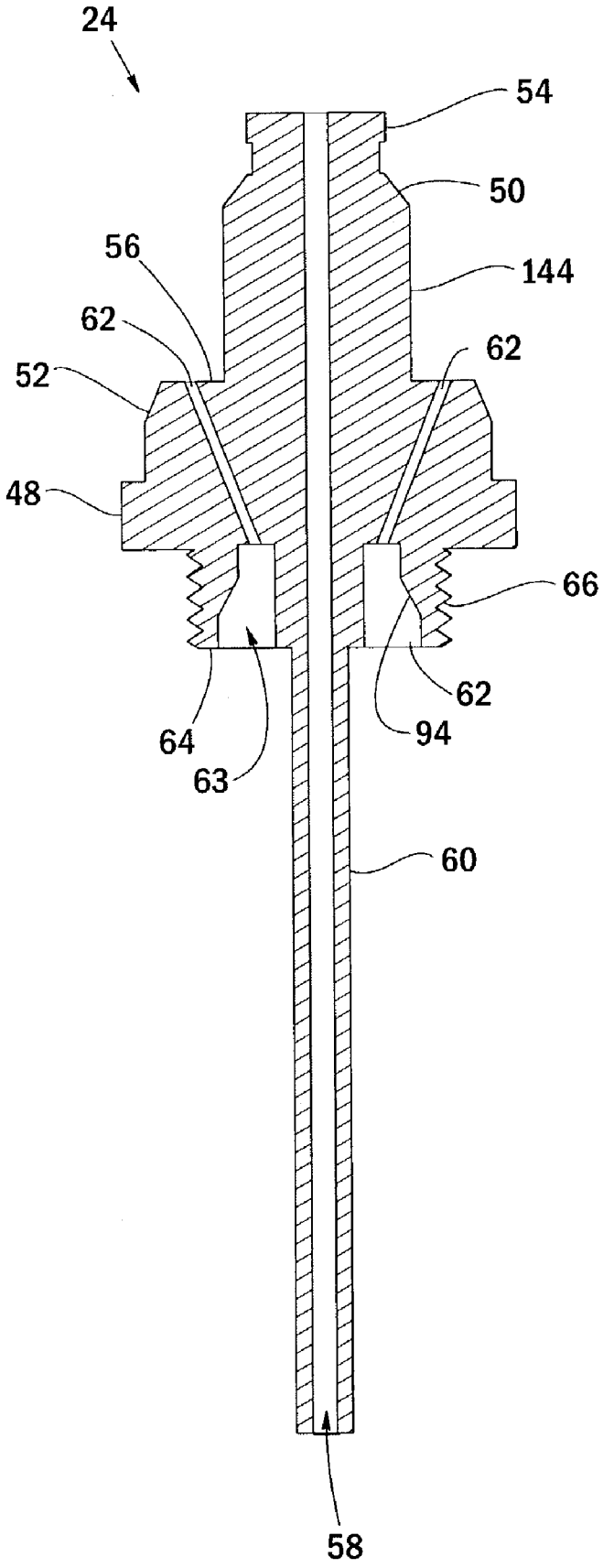
Figure 4:
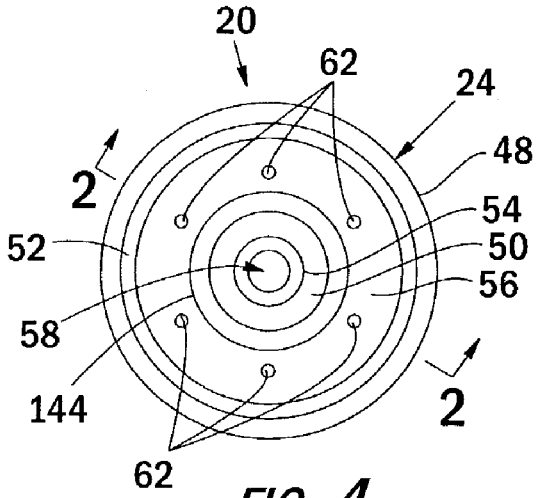
Figure 5:
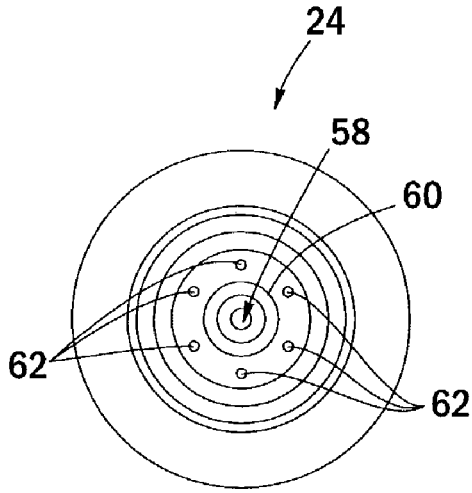
Figure 7:
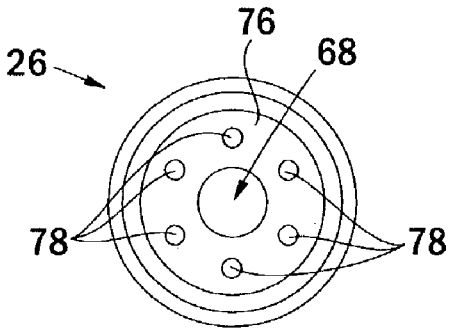
Figure 8:
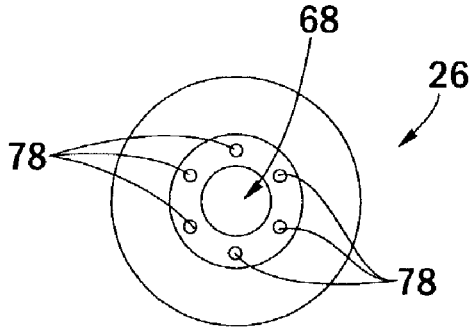
Figure 6:
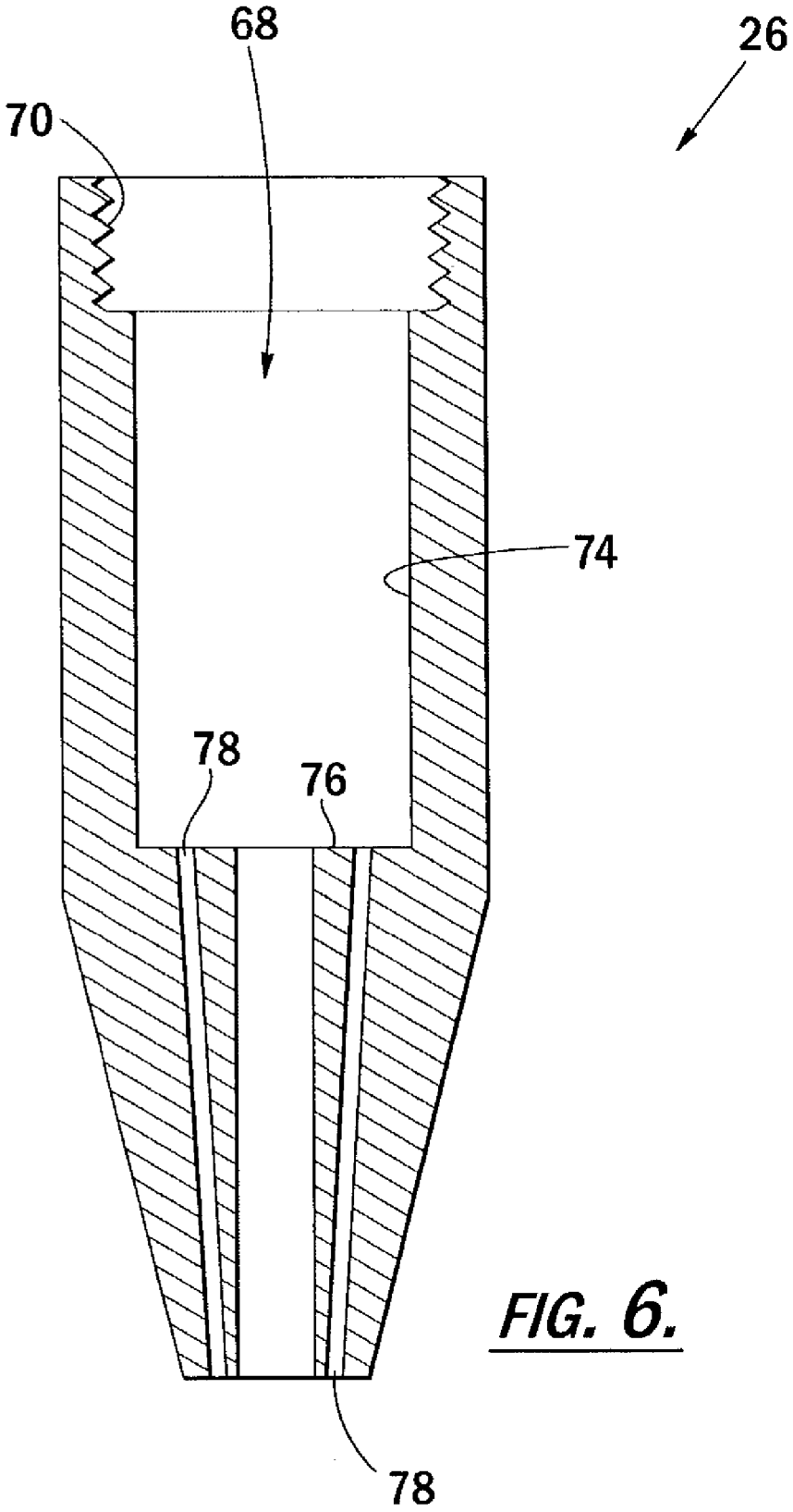
Figure 9:
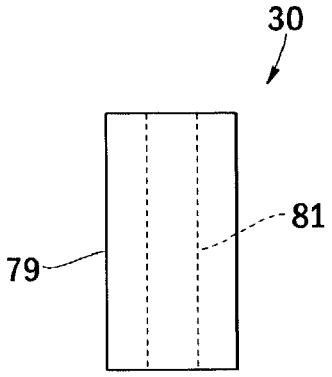
Figure 10:
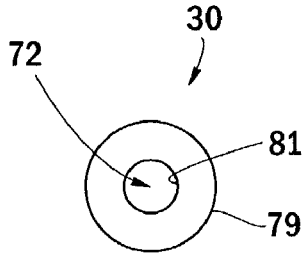
Figure 11:
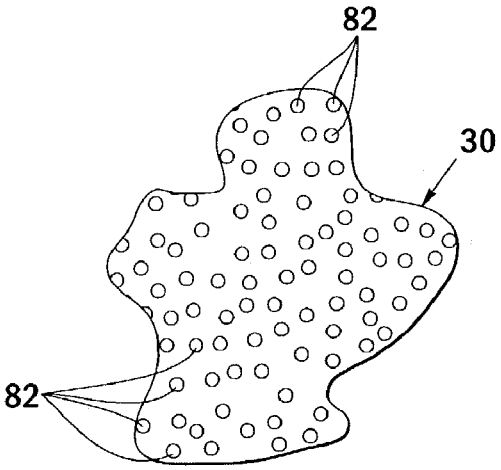
Figure 12:
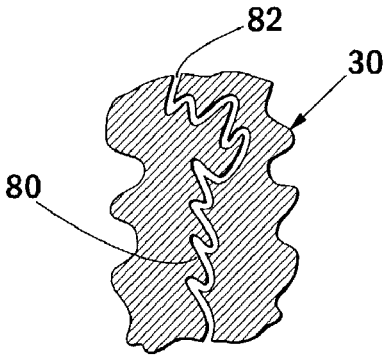
Figure 13:
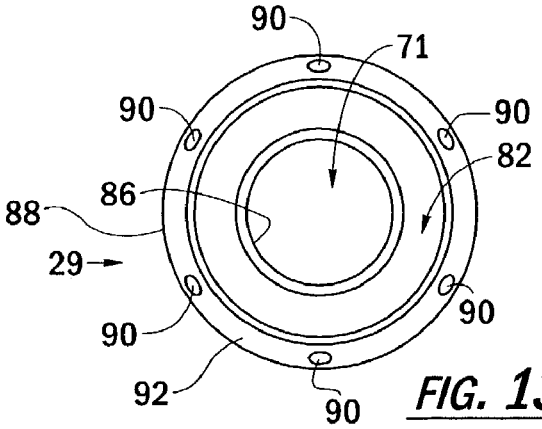
Figure 14:
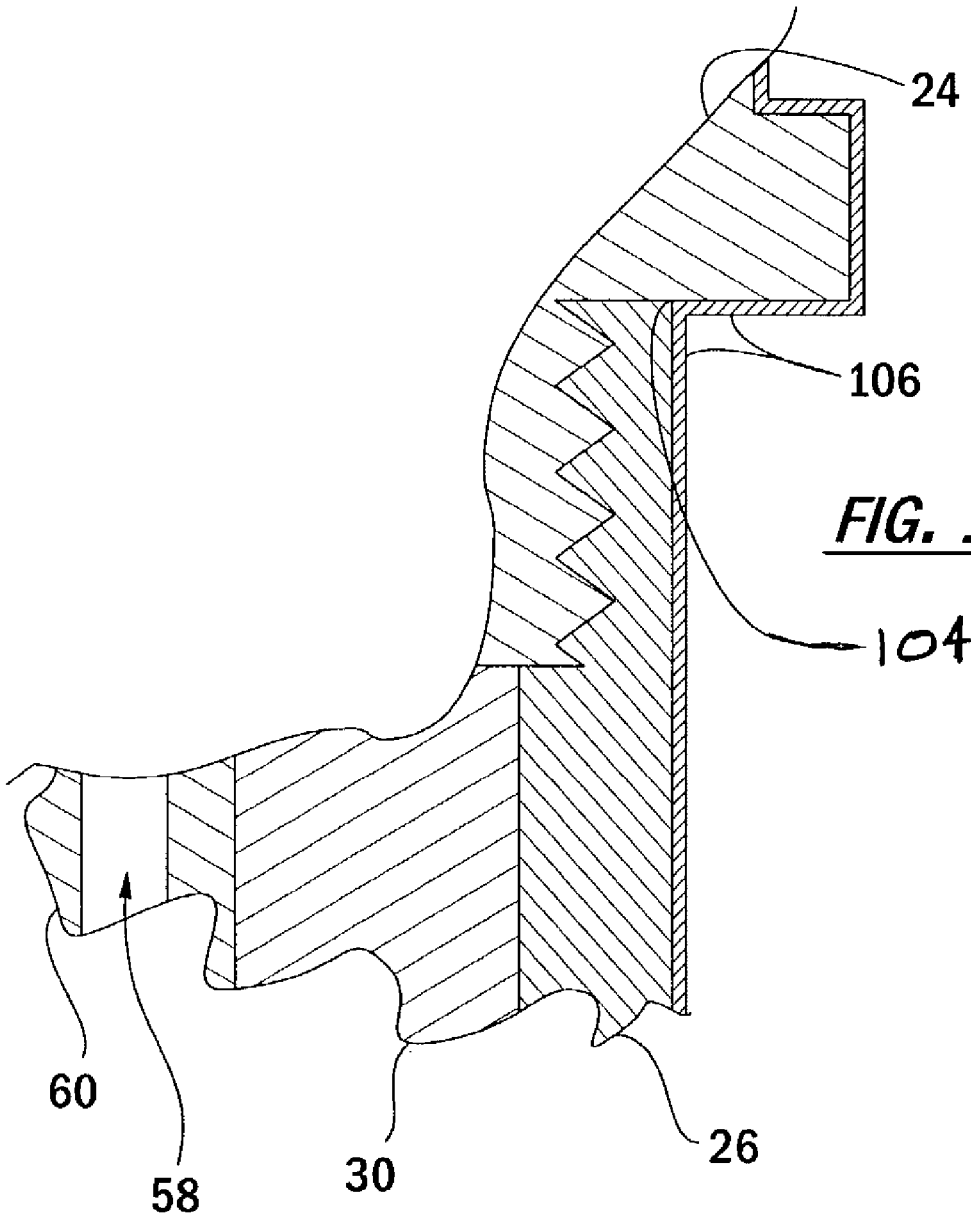
Figure 15:
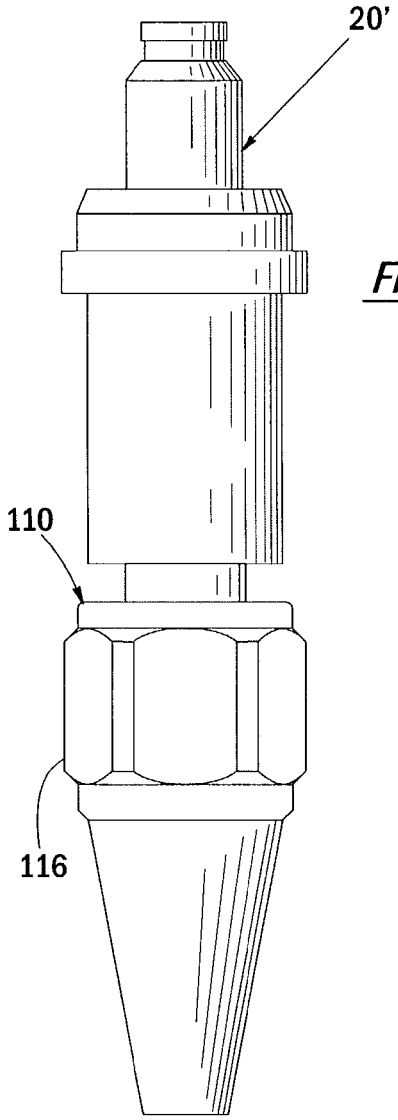
Figure 16:
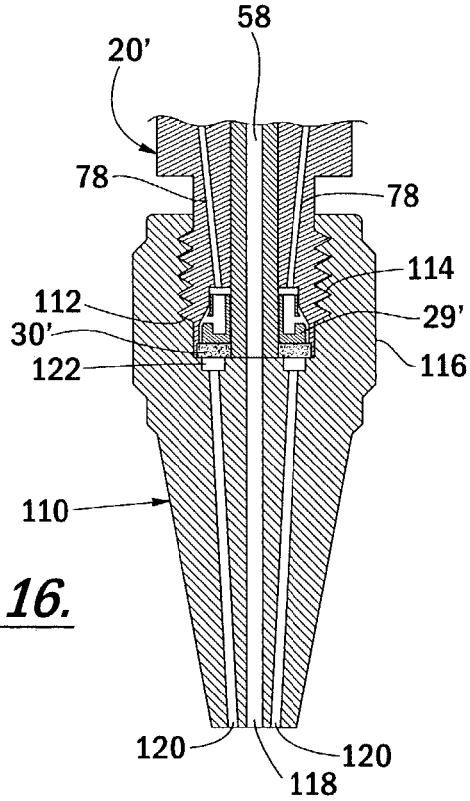

Having thus described the invention in general terms, reference will now be made to the accompanying drawings, which are not necessarily drawn to scale and the majority of which are at least partially schematic, and wherein:

FIG. 1 is an exploded view of a cutting tip of the present invention and a head of a conventional cutting torch, wherein a nut encircling the cutting tip and the head are cross-sectioned along their axes, and a porous structure and valve plug that are internal to the cutting tip are shown in broken lines, in accordance with one embodiment of the present invention;

FIG. 2 is an isolated, axial cross-sectional view of the cutting tip of FIG. 1, and, more specifically, FIG. 2 is a cross-sectional view of the cutting tip taken along line 2—2 of FIG. 4;

FIG. 3 is an isolated, axial cross-sectional view of an inner part of the cutting tip, and, more specifically, FIG. 3 is an isolated cross-sectional view of the inner part taken along line 2—2 of FIG. 4;

FIG. 4 is a top plan view of the cutting tip, which is identical to a top plan view of the inner part;

FIG. 5 is a bottom plan view of the inner part;

FIG. 6 is an isolated, cross-sectional view of an outer part of the cutting tip taken along line 2—2 of FIG. 4;

FIG. 7 is a top plan view of the outer part;

FIG. 8 is a bottom plan view of the outer part;

FIG. 9 is an elevational view of the porous structure;

FIG. 10 is a plan view of the porous structure;

FIG. 11 is an enlarged, partial view illustrating pores of the porous structure;

FIG. 12 is an enlarged, cross-sectional view illustrating a representative convolute path formed by the pores of the porous structure;

FIG. 13 is an isolated, top plan view of the valve plug;

FIG. 14 is a partial, cross-sectional view of a cutting tip that has been axially cross-sectioned in the same manner that is indicated by lines 2—2 of FIG. 4, in accordance with another embodiment of the present invention;

FIG. 15 is an elevational view of a combination of an adapter and cutting tip, in accordance with another embodiment of the present invention; and FIG. 16 is a partial view of the combination of FIG. 15 axially cross-sectioned in the same manner that is indicated by lines 2—2 of FIG. 4.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring to FIG. 1, a fitting in the form of a cutting tip 20 is shown exploded away from a head 22 of a conventional oxy-fuel cutting torch, in accordance with a first embodiment of the present invention. Briefly described, and as best understood with reference to FIG. 2, the cutting tip 20 of the first embodiment preferably includes coaxial inner and outer parts 24, 26 that are mounted to one another and together provide a nozzle 28 that is located at a lower end of the cutting tip for discharging oxygen and fuel gas. In accordance with an alternative embodiment of the present invention, rather than including both the inner and outer parts 24 and 26, these two parts are combined into a single piece or they are made up of additional parts.

In accordance with the first embodiment of the present invention, an internal valve plug 29 and preferably also an internal porous structure 30 are within a common interior chamber of the cutting tip 20 for restricting flashback from passing through the cutting tip, as will be discussed in greater detail below. The valve plug 29 and porous structure 30 are hidden from view in FIG. 1 and are therefore illustrated by broken lines. Each of the valve plug 29 and porous structure 30 are preferably coaxial with each of the inner and outer parts 24, 26. The cutting tip 20 is preferably removably mounted to the head 22 in a conventional manner by an externally threaded nut 32 (FIG. 1), as will be discussed in greater detail below.

As best understood with reference to FIG. 1, the head 22 includes an interior surface that extends around an axis to define a composite cavity 34 that is open at the lower end of the head. The interior surface of the head 22 includes annular upper and lower seating surfaces (i.e., upper and lower seats 36, 38) that are coaxial with the composite cavity 34 and define an oblique angle with respect to the axis of the composite cavity. The interior surface of the head 22 further defines interior threads 40 that are coaxial with the composite cavity 34. The head further includes an oxygen port 42 that is open to the composite cavity 34 and is for receiving gaseous oxygen from an oxygen supply. Likewise, the head includes a fuel port 44 that is open to the composite cavity 34 and is for receiving fuel gas from a fuel supply. In accordance with the first embodiment of the present invention, the fuel gas includes a "premixed" mixture of oxygen and a gaseous fuel, such as acetylene, or the like. However, the present invention is also applicable to "post-mixed" cutting torches and other types of torches, as will be discussed in greater detail below.

The "oxygen supply" and "fuel supply" illustrated in FIG. 1 are representative of conventional gas supplies and conventional cutting torch components that are upstream from the head 22. In one specific example, the "oxygen supply" and "fuel supply" illustrated in FIG. 1 are representative of a control body connected to separate fuel gas and oxygen supplies, and they are also respectively illustrative of tubes for supplying the oxygen and fuel gas from the control body to the head, with the control body including valves and related components for controlling the operations of the torch.

The cutting tip 20 is preferably mounted to the head 22 by inserting the upper end of the cutting tip into the composite cavity 34 and then engaging exterior threads 46 of the nut 32 to the interior threads 40 of the head. The nut 32 is rotated so that an annular upper edge of the nut engages a lower surface of a lower flange 48 of the cutting tip 20, to force the cutting tip into the composite cavity 34. Movement of the cutting tip 20 into the composite cavity 34 ceases when the cutting tip is coaxial with the composite cavity and fully engages the seats 36, 38 of the head 22. More specifically, the cutting tip 20 includes annular upper and lower seating surfaces (i.e., upper and lower seats 50, 52) that extend coaxially around the axis of the cutting tip and at an oblique angle thereto, and the seats 50, 52 of the cutting tip respectively coaxially and securely engage the seats 36, 38 of the head 22 while the cutting tip is fully mounted to the head.

In accordance with the first embodiment of the present invention, an oxygen chamber is formed within the upper region of the composite cavity 34 while the upper seats 36, 50 are securely engaged to one another. The oxygen chamber is open to the oxygen port 42 and closed to the fuel port 44, and an upper flange 54 of the cutting tip 20 is positioned within the oxygen chamber. At the same time, the lower seats 38, 52 are securely engaged to one another so that a fuel chamber is formed within the composite cavity 34 in the axial space between the upper seats 36, 50 and the lower seats 38, 52. The fuel chamber is open to the fuel port 44 and closed to the oxygen port 42, and an upper shoulder 56 of the cutting tip 20 is positioned within the fuel chamber.

Referring to the inner part 24 shown in FIGS. 2-5, an oxygen passageway 58 extends coaxially through the inner part. The oxygen passageway 58 has an inlet at the upper end of the inner part 24, extends through a stem 60, and includes an outlet at the lower end of the inner part. As best understood with reference to FIG. 3, multiple upstream fuel passageways 62 extend through the inner part 24 and are positioned around and radially distant from the axis of the inner part. Each upstream fuel passageway 62 includes an inlet at the upper shoulder 56. The outlets of the upstream fuel passageways 62 are open to an annular valve chamber 63 that encircles and is coaxial with, yet isolated from, the oxygen passageway 58. The valve chamber 63 contains the movable valve plug 29 (FIGS. 1, 2 and 13), as will be discussed in greater detail below. Coaxial external threads 66 of the inner part 24 are for mounting the inner part 24 to the outer part 26.

As best understood with reference to FIG. 2, in accordance with the first embodiment of the present invention, the valve chamber 63 (FIG. 3) is preferably adjacent/contiguous with a coaxial annular chamber that contains the porous structure 30, and these two chambers can be referred to collectively as a composite annular space or composite chamber of the cutting tip 20. That is, the composite chamber can be characterized as including both the valve chamber 63 and the chamber that contains the porous structure 30. It is preferred for the composite chamber to include both the valve plug 29 and the porous structure 30 in an arrangement such that the porous structure functions as a stop against which the valve plug is abutted while the valve plug is in its open or closed position. Most preferably the valve plug 29 is abutted against the porous structure 30 while the valve plug is in its open position, which is shown in FIG. 2 and discussed in greater detail below. In accordance with an alternative embodiment of the present invention, the valve chamber 63 and the chamber that contains the porous structure 30 are not contiguous and the valve plug 29 and porous structure do not abut one another.

The chamber that contains and is preferably fully occupied by the porous structure 30 is preferably partially defined by both of the inner and outer parts 24, 26; therefore, that chamber can be best understood by further referring to structures of the outer part and by describing how the inner and outer parts are assembled to one another. Referring to the outer part 26 shown in FIGS. 2 and 6–8, it includes an interior surface that extends coaxially around the elongate axis of the inner part 24 to define a central bore 68 (FIGS. 6–8). The central bore 68 is open at the upper and lower ends of the outer part 26 while the outer part is isolated from the other parts of the cutting tip 20.

Regarding assembling the cutting tip 20 as shown in FIG. 2, the interior surface of the outer part 26 includes coaxial interior threads 70 that engage the exterior threads 66 of the inner part 24 after the stem 60 of the inner part is inserted through the valve plug 29, porous structure 30, and central bore 68. Then, the inner and outer parts 24, 26 are coaxially rotated relative to one another so that via the threads 66, 70 the inner part is fully screwed into the central bore 68, as illustrated in FIG. 2. That is, the cutting tip 20 can be assembled by inserting the stem 60 through a coaxial plug bore 71 (FIG. 13) defined through the valve plug 29 and through a coaxial bore 72 (FIG. 10) defined through the porous structure 30, thereafter inserting the stem through the central bore 68 of the outer part 26, and then relatively rotating the inner and outer parts 24, 26 so that the threads 66, 70 mesh and the upper end of the outer part thereafter engages the underside of the lower flange 48 (FIGS. 1–3) of the inner part.

As best understood initially with reference to FIGS. 6 and 3, the interior surface of the outer part 26 also includes a coaxial, cylindrical interior surface 74 and a coaxial, annular interior shoulder 76 which together with the exterior surface of the stem 60 and a lower shoulder 64 of the inner part 24 at least partially define the coaxial annular chamber that contains the porous structure 30. The coaxial annular chamber that contains the porous structure 30 is preferably substantially fully occupied by the porous structure.

While the cutting tip 20 is fully assembled as illustrated in FIG. 2, the composite annular chamber that contains both the valve plug 29 and the porous structure 30 is completely closed, except for being open to the outlets of the upstream fuel passageways 62 and inlets of downstream fuel passageways 78. The downstream fuel passageways 78 extend through the outer part 26 and are positioned around and radially distant from the axis of the outer part. Each downstream fuel passageway 78 includes an inlet at the interior shoulder 76 and an outlet at the lower end of the outer part 26.

As best understood with reference to FIG. 2, the cutting tip 20 can be characterized as including a composite fuel passageway that includes the upstream fuel passageways 62, the composite annular space or chamber containing the valve plug 29 and porous structure 30, and the downstream fuel passageways 78. However, other composite fuel passageways, or the like, are within the scope of the present invention.

Referring to FIGS. 9–10, the porous structure 30 is annular and includes cylindrical and coaxial outer and inner surfaces 79, 81. The inner surface 81 of the porous structure extends around and defines the bore 72 that receives the stem 60 and is opened at opposite ends of the porous structure 30. While the cutting tip 20 is assembled as illustrated in FIG.

2, the outer and inner surfaces 79, 81 of the porous structure 30 preferably respectively securely engage the interior surface 74 of the outer part 76 and the exterior surface of the stem 60 of the inner part 24. In addition, the opposite ends of the porous structure 30 respectively securely engage a radially inward portion of the lower shoulder 64 of the inner part 24, and the interior shoulder 76 of the outer part 26. As a result of the porous structure 30 firmly engaging the interior surface 74, stem 60, lower shoulder 64, and interior shoulder 76, gas that flows from the upstream fuel passageways 62 (or more specifically from the valve plug 29) to the downstream fuel passageways 78 is forced to flow through convolute passageways 80 (FIG. 12) of the porous structure. Likewise, any flashback attempting to travel from the downstream fuel passageways 78 to the upstream fuel passageways 62 (or more specifically to the valve plug 29) is forced to travel through the multiplicity of convolute passageways 80 of the porous structure 30, which preferably extinguishes the flashback.

Referring to the schematic and enlarged views of FIGS. 11–12, the porous structure 30 includes a multiplicity of pores 82 (only a representative few of which are identified by their reference numeral in FIG. 11), with each defining at least part of a convolute path 80 extending through the porous structure. In accordance with one example of the first embodiment of the present invention, the porous structure 30 is preferably sintered bronze or sintered stainless steel, or the like, with a pore size of about five microns, and preferably there are at least about, and most preferably more than, a hundred of the pores 82/convolute passageways 80 in several square inches of the sintered material. The pore size is an approximate measure of a representative pore 82 in a direction perpendicular to the flow therethrough. In accordance with the first embodiment of the present invention, the preferred pore size and the number of pores may vary widely, depending upon many factors associated with the manufacture and operation of the cutting torch; therefore, pore sizes other than five microns and densities other than a hundred of the pores 82/convolute passageways 80 in several square inches may be used in some applications. Further, and in accordance with an alternative embodiment of the present invention, the porous structure can be any type of material for both allowing the cutting torch to operate in a normal fashion and performing a flashback restricting function. In accordance with this alternative embodiment, the porous structure can be tightly packed steel wool, or the like, or one or more screens that are preferably arranged in layers, or the like.

Referring to FIGS. 2 and 13, the valve plug 29, which is coaxially and movably positioned in the valve chamber 63, preferably includes one or more fuel pathways that are defined therethrough. More specifically and in accordance with the first embodiment, the valve plug 29 includes an upwardly open, annular plug groove 84 that is preferably coaxial with the valve plug, and multiple plug ports 90 that are open to and extend radially outward from the plug groove. That is, and in accordance with the first embodiment, the annular plug groove 84 together with the plug ports 90 can be characterized as providing the one or more fuel pathways that extend through the valve plug 29. It is preferred for a respective portion of the valve plug 29 to extend completely around at least a portion of each of the fuel pathways extending through the valve plug. In accordance with the first embodiment of the present invention, this feature is provided by virtue of the plug ports 90 being in the form of cylindrical bores, although this feature can be provided by other means. That is, other valve plugs and fuel pathway(s) of the valve plugs are within the scope of the present invention.

In accordance with the first embodiment of the present invention, and as best understood with reference to FIGS. 2 and 13, annular and coaxial inner and outer walls 86, 88 of the valve plug 29 are respectively in sliding, face-to-face contact with corresponding interior annular walls of the inner part 24, so that the only way for fuel from the upstream fuel passageways 62 to get past the valve plug is via the fuel pathways extending through the valve plug (e.g., the plug groove 84 and multiple plug ports 90). More specifically, and in accordance with the first embodiment, the inner wall 86 of the valve plug 29 extends around and defines the plug bore 71 that receives the stem 60 of the inner part 24.

Ends of the plug ports 90 are each open at an annular obstructing wall 92 of the valve plug 29. The obstructing wall 92 is in opposing face-to-face relation with, and movable with the valve plug 29 relative to, an annular valve seat 94 (FIG. 3) of the inner part 24. Preferably the obstructing wall 92 and valve seat 94 are parallel to one another and extend obliquely with respect to the elongate axis of the cutting tip 20. In accordance with the first embodiment of the present invention, the obstructing wall 92 and the valve seat 94 are sized and arranged so that when the valve plug 29 moves sufficiently toward the inlet end of the cutting tip 20, the obstructing wall 92 and the valve seat 94 are in contact such that fuel can no longer flow past the valve plug 29/through the fuel pathways of the valve plug. Conversely, when the valve plug 29 moves sufficiently toward the outlet end of the cutting tip 20, such as when the bottom of the valve plug 29 abuts the upper end of the porous structure 30 as illustrated in FIG. 2, fuel can flow past the valve plug 29/through the fuel pathways of the valve plug 29.

In accordance with the first embodiment of the present invention, the combination of at least the obstructing wall 92 and the valve seat 94 can be characterized as a check valve, or the like, and the check valve is shown in its open position in FIG. 2. While the check valve is open, after fuel flows through the fuel pathways of the valve plug 29 (e.g., after fuel is discharged from the outlets of the plug ports 90), that fuel preferably flows to the porous structure 30 via an annular chamber of the check valve, or the like. The annular chamber of the check valve is partially defined between the obstructing wall 92 (FIG. 13) and the valve seat 94 (FIG. 3), and further defined between the outer wall 88 (FIGS. 2 and 13) of the valve plug 29 and the wall of the inner part 24 that is in opposing face-to-face relation with the of the outer wall 88 of the valve plug.

An exemplary method of operating the cutting torch of the first embodiment of the present invention is described in the following, and this method can be best understood with reference to FIGS. 1–2. Oxygen and fuel are supplied to the head 22 while the cutting tip 20 is fully mounted thereto, so that oxygen flows through the oxygen passageways 58, and fuel flows through the upstream fuel passageways 62, through and past the valve plug 29, through the porous structure 30, and then through the downstream fuel passageways 78. That is, and more generally described in accordance with the first embodiment of the present invention, the valve plug 29 and porous structure 30 are positioned in and at least partially define the fuel passageway(s) of the cutting tip 20.

Differential pressure resulting from flow toward the nozzle 28 through the fuel passageways(s) of the cutting tip 20 holds the valve plug 29 in its open position, which is illustrated in FIG. 2. In accordance with the exemplary method, the fuel is discharged from the nozzle 28 and ignited to form a preheat flame that is used to heat a metal workpiece. Further in accordance with the exemplary method, after the preheat flame has heated the workpiece sufficiently, a high velocity cutting oxygen stream is activated and delivered through the nozzle 28 via the oxygen passageway 58. The high velocity cutting oxygen stream physically removes molten material of the workpiece by oxidation, to cut the workpiece. If during this operation flashback occurs as a result of reverse flow and ignition of the explosive mixture of gases, such as due to an obstruction at the nozzle 28, the convolute passageways 80 of the porous structure 30 and/or closure of the check valve/valve plug 29 advantageously restrict the flashback from reaching the upstream fuel passageways 62. More specifically, differential pressure resulting from flow toward the upper flange 54 through the fuel passageway(s) of the cutting tip 20 moves the valve plug 29 to the closed position and releasably holds in the valve plug 29 in its closed position. Although flashback is sometimes at least partially attributable to a misdirection of the high velocity cutting oxygen stream that is activated and delivered through the nozzle 28 via the oxygen passageway 58, the present invention is also applicable to cutting tips that do not include oxygen passageway(s) for delivering high velocity cutting oxygen streams.

Whereas the porous structure 30 can be characterized as a passive flashback restrictor since the porous structure's flashback restricting function does not require any movement of the porous structure, the check valve/valve plug 29 can be characterized as an active flashback restrictor since the valve plug can restrict flashback by moving from the open position to the closed position, with these positions preferably being as described above. In accordance with the first embodiment of the present invention, the valve plug 29 advantageously automatically moves between its open and closed positions in a manner such that while the cutting tip 20 and associated torch are operating to produce a flame at the nozzle 28, the valve plug 29 does not substantially interfere with the flow of fuel to the nozzle (i.e., the check valve remains open) irrespective of the orientation of the nozzle, except that the valve plug quickly repositions to substantially block flow from passing in either direction (i.e., the check valve closes) between the fuel passageways 62 and 78 in the event of flashback. In accordance with the first embodiment of the present invention, the operational characteristics of the check valve and the sintered material 30 can be balanced to provide an optimal balance between operating properties of the cutting tip 20. Nonetheless, in accordance with an alternative embodiment of the present invention, only the check valve is included in the cutting tip. That is, rather than including the sintered material 30, which in the first embodiment plays a role in containing the valve plug 29 in the valve chamber 63, an alternative embodiment of the present invention includes an additional shoulder, flange, lug, or the like, for releasably holding the valve plug 29 in its open position, or other means may be provided for releasably holding the valve plug in its open position.

When flashback reaches and is extinguished by the porous structure 30 and/or the check valve/valve plug 29, solid byproducts of the flashback, such as carbon, may be deposited. These deposits may collect in the pores 82/convolute passageways 80 of the porous structure and in the pathways of, or in the vicinity of, the valve plug 29. As a result, the porous structure 30 can eventually become clogged so that it is too restrictive to the desired flow of fuel therethrough and/or the check valve can eventually become clogged or fouled so that it is too restrictive to the desired flow of fuel therethrough and/or there-past. In this case and in accordance with the first embodiment of the present invention, the used cutting tip 20 is preferably discarded in its entirety and replaced with a new cutting tip. Completely discarding the used cutting tip 20 and replacing it with a new one prevents malfunctioning that could occur if a user incorrectly installs a new porous structure 30 or valve plug 29, or removes and does not replace a clogged porous structure or fouled valve plug. In this regard, the cutting tip 20 can be generally characterized as a "one-piece" consumable item that is completely discarded if/when it becomes clogged. Alternatively, the porous structure 30 and valve plug 29 can be readily removable from the cutting tip 20 and replaced.

In accordance with another embodiment of the present invention, as an alternative to, or in addition to, the porous structure 30 being positioned in the coaxial annular chamber of the cutting tip 20, as is illustrated in FIGS. 1–2, plug-like pieces of the porous structure can be coaxially positioned within each of the upstream fuel passageways 62 and/or each of the downstream fuel passageways 78, or combinations of these passageways, and these passageways may be enlarged to optimally accommodate the plugs. Similarly, porous structure(s) and/or valve plug(s) can be positioned at other locations in or adjacent to the fuel path(s) that are at least partially defined through the cutting tip 20, or the like.

Referring to FIGS. 1–2, an exterior seam 104 is formed where the upper end of the outer part 26 abuts the lower surface of the lower flange 48 of the inner part 24, in accordance with the first embodiment of the present invention. In accordance with another embodiment of the present invention that is partially illustrated in FIG. 14, at least the exterior seam 104, and preferably a substantial portion or the entirety of the exterior surface of the cutting tip 20, is optionally covered with a coating 106 or otherwise machined in a manner that at least partially fills and/or obscures the exterior seam 104. This advantageously prevents, or at least deters, disassembly of the cutting tip 20, either mechanically by making it more difficult to unscrew the components, or visually by causing an operator to believe that the absence of visible seams indicates that the tip 20 is a unitary part that cannot be disassembled. That is and advantageously, the porous structure 30 and valve plug 29 are substantially inaccessible within the cutting tip 20, so that it will be understood that the porous structure and valve plug are not to be replaced. By deterring disassembly, the complete replacement of clogged cutting tips 20 is promoted, which will advantageously avoid malfunctioning that could occur if a user incorrectly installs a new porous structure 30 and/or valve plug 29 or, even worse, removes and does not replace a clogged porous structure or valve plug. Accordingly, the cutting tip 20 is preferably a disposable component. Alternatively, the porous structure 30 and valve plug 29 can be readily removed from the cutting tip and are replaceable.

Further referring to the embodiment of FIG. 14, an acceptable coating 106 is an anodized coating. A suitable anodized coating can be applied to the cutting tip 20 by a conventional anodic coating process, or the like. Anodic coating includes electrolytically treating the cutting tip 20 so that a film of oxides is formed on its outer surfaces to form the coating 106. Other coating techniques are also within the scope of the present invention, with the resulting coatings preferably being sufficient for deterring disassembly of the cutting tip. Alternatively, the coating 106, or the like, can be formed to obscure the exterior seam 104 by brazing the inner and outer pieces 24, 26 of the cutting tip 20 in the region of the external seam, so that disassembly of the cutting tip is substantially deterred.

FIGS. 15–16 illustrate a composite fitting including a cutting tip 110 coaxially mounted to a fitting that is in the form of an adapter 20', in accordance with a second embodiment of the present invention. In accordance with the second embodiment, the adapter 20' is like the cutting tip 20 of the first embodiment of the present invention, with or without the coating 106 (FIG. 14), except for variations noted and variations that will be apparent to those of ordinary skill in the art. In accordance with one version of the second embodiment, the adapter 20' does not contain a valve plug 29 (FIGS. 1, 2 and 13) and/or porous structure 30 (FIGS. 1, 2 and 9–12), in which case the size of the interior chamber of the adapter can be reduced, or the interior chamber can be eliminated, such as by forming the adapter as a one-piece component. In contrast and in accordance with another version of the second embodiment, the composite chamber of the adapter 20' does contain the valve plug 29 and/or the sintered material 30. Also in accordance with the second embodiment of the present invention, rather than the adapter 20' including a tapered nozzle 28 (FIG. 1), the adapter includes exterior threads 112 (FIG. 16) that mesh with interior threads 114 (FIG. 16) of the cutting tip 110, so that the cutting tip can be removably screwed onto the adapter to achieve the configuration illustrated in FIGS. 15–16. The cutting tip 110 preferably includes a hexagonal outer structure 116 for receiving a wrench and facilitating the screwing of the cutting tip 110 onto and off of the adapter 20'.

Referring to FIG. 16, a terminal oxygen passageway 118 extends coaxially through the cutting tip 110, and terminal fuel passageways 120 of the cutting tip are positioned around and radially distant from the axis of the cutting tip. The passageways 118, 120 of the cutting tip 110 will now be described for the configuration in which the cutting tip is fully mounted to the adapter 20', as illustrated in FIGS. 15–16. The inlet of the terminal oxygen passageway 118 is open solely to the outlet of the oxygen passageway 58 of the adapter 20', and the outlet of the oxygen passageway 58 is open solely to the inlet of the terminal oxygen passageway 118. The outlet of the terminal oxygen passageway 118 is open at the lower end (i.e., nozzle) of the cutting tip 110.

In accordance with the second embodiment of the present invention, the adapter 20' and cutting tip 110 include coaxial annular channels that face and are open to one another to form an annular chamber 122 that encircles and is coaxial with the oxygen passageways 58, 98. The annular chamber 122 is completely closed, except for being open to the outlets of the downstream fuel passageways 78 and inlets of the terminal fuel passageways 120. The outlets of the terminal fuel passageways 120 are at the lower end of the cutting tip 110.

In accordance with one example of the second embodiment of the present invention, the adapter 20' is mounted to the head 22 (FIG. 1) and functions just like the cutting tip 20 of the first embodiment of the present invention, except that the oxygen and fuel are discharged out of the nozzle of the cutting tip 110. Additionally, if the cutting tip 110 becomes damaged, it can be advantageously replaced with a new one while the adapter 20' remains mounted to the head 22. In this regard, the combination of the adapter 20' and the cutting tip 110 can be generally characterized as a "two-piece" item, with the tip 110 being the consumable item. Conversely, if it is necessary to change the adapter 20' because of less than optimal functionality due to the accumulation of deposits from previous flashbacks, the cutting tip 110 currently being used can be removed from the old adapter and placed on the new adapter, to avoid discarding a usable cutting tip.

As illustrated in FIG. 16, and in accordance with the second embodiment of the present invention, a valve plug 29' and a porous structure 30' are positioned in an upper portion of the annular chamber 122, and the valve plug 29' and porous structure 30' of the second exemplary embodiment are respectively like the valve plug 29 (FIGS. 1, 2 and 13) and porous structure 30 (FIGS. 1, 2 and 9–12) of the first exemplary embodiment, both structurally and functionally, except for variations noted and variations that will be readily apparent to those of ordinary skill in the art in view of this disclosure. In accordance with an alternative embodiment of the present invention in which the adapter 20' contains a valve plug 29 and/or a porous structure 30 as described above for the first embodiment of the present invention, the chamber 122 illustrated in FIG. 16 does not include the porous structure 30' and/or the valve plug 29', in which case the chamber 122 can be reshaped accordingly.

Those of ordinary skill in the art understand that oxy-fuel torches include both "post-mixed" and "premixed" cutting torches, and that the above-described embodiments of the present invention have been primarily described in the context of premixed cutting torches. That is, and as best understood with reference to FIG. 1, in accordance with illustrated embodiments of the present invention, the fuel supplied via the fuel port 44 is a mixture of oxygen and a fuel gas, such as acetylene, or the like. Although the present invention has been described above primarily in the context of "premixed" torches, the present invention is also applicable to "post-mixed" cutting torches and other types of torches.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A fitting for being mounted to a head of a torch for receiving at least fuel from the head and restricting flashback, the fitting comprising:

a fuel passageway having a fuel inlet proximate a first end of the fitting for receiving fuel from the head, and a fuel outlet for discharging the fuel; and an annular valve plug movably positioned in the fuel passageway for moving from an open position to a closed position in response to reverse flow in the fuel passageway, so as to restrict flashback from passing through the fuel passageway, wherein the valve plug includes a pathway, a portion of the valve plug extends completely around the pathway, the pathway is open while the valve plug is in the open position, and the pathway is closed while the valve plug is in the closed position, so as to restrict flashback from passing through the pathway;

a valve seat that is in opposing face-to-face relation with a wall of the valve plug, wherein the wall of the valve plug defines a first opening to the pathway and is engaged to the valve seat while the valve plug is in the closed position, so that the first opening to the pathway is closed by the valve seat while the valve plug is in the closed position, wherein the wall of the valve plug and the valve seat extend obliquely with respect to an elongate axis of the fitting, with the elongate axis extending in a direction from the first end of the fitting to a second end of the fitting, wherein the pathway includes a second opening that is open to an annular groove of the valve plug, the groove encircling the elongate axis of the fitting and having a first end that is open to the fuel outlet of the upstream fuel passageway and is closer to the first end of the fitting than to the second end of the fitting, and the pathway extending radially away from the groove; and a porous structure having a multiplicity of convolute passageways extending therethrough, wherein the porous structure is positioned in an annular space of the fuel passageway to restrict flashback from passing through the annular space, a second end of the valve plug, which is opposite from the first end of the valve plug, is adjacent the porous structure, and the porous structure is positioned to function as a stop against which the second end of the valve plug abuts while the valve plug is in the open position.

2. A fitting for being mounted to a head of a torch for receiving at least fuel from the head and restricting flashback, the fitting comprising:

a fuel passageway having a fuel inlet proximate a first end of the fitting for receiving fuel from the head, and a fuel outlet for discharging the fuel;

an annular valve plug movably positioned in the fuel passageway for moving from an open position to a closed position in response to reverse flow in the fuel passageway, so as to restrict flashback from passing through the fuel passageway, wherein the valve plug includes a pathway, a portion of the valve plug extends completely around the pathway, the pathway is open while the valve plug is in the open position, and the pathway is closed while the valve plug is in the closed position, so as to restrict flashback from passing through the pathway;

an oxygen passageway having an oxygen inlet proximate the first end of the fitting for receiving oxygen from the head, and an oxygen outlet proximate a second end of the fitting for discharging the oxygen from the fitting, wherein the fuel passageway includes an annular space that extends around the oxygen passageway, and the valve plug is annular and is positioned in the annular space and extends around the oxygen passageway; and a porous structure having a multiplicity of convolute passageways extending therethrough, wherein the porous structure is positioned in the annular space to restrict flashback from passing through the annular space, and the valve plug is adjacent the porous structure.

3. A fitting according to claim 2, wherein the porous structure is positioned to function as a stop against which the valve plug abuts while the valve plug is in the open position.

4. A fitting according to claim 2, wherein:

the annular space is an annular chamber that is isolated from the oxygen passageway and is positioned between and distant from the first and second ends of the fitting; and the fuel passageway further includes:

an upstream fuel passageway positioned radially distant from the oxygen passageway, with the upstream fuel passageway including the fuel inlet and the fuel outlet, with the fuel outlet being open to the chamber for discharging fuel into the chamber, and a downstream fuel passageway positioned radially distant from the oxygen passageway, with the downstream fuel passageway having an inlet that is open to the chamber for receiving fuel from the chamber, and an outlet proximate the second end for discharging the fuel from the fitting.

5. A fitting according to claim 2, wherein:

the annular space is an annular chamber that is isolated from the oxygen passageway and is positioned between the first and second ends; and the fuel passageway further includes:

upstream fuel passageways that are positioned around the oxygen passageway, with each upstream fuel passageway being positioned radially distant from the oxygen passageway, and each upstream fuel passageway having an inlet proximate the first end for receiving fuel from the head, and an outlet that is open to the chamber for discharging the fuel into the chamber, and downstream fuel passageways that are positioned around the oxygen passageway, with each downstream fuel passageway being positioned radially distant from the oxygen passageway, and each downstream fuel passageway having an inlet that is open to the chamber for receiving fuel from the chamber, and an outlet proximate the second end for discharging the fuel from the fitting.

6. A fitting according to claim 5, wherein a first part of the fitting is mounted to a second part of the fitting, surfaces of the first and second parts together at least partially define the chamber containing the valve plug, the first part includes the upstream fuel passageways, and the second part of the body includes the downstream fuel passageways.

7. A fitting according to claim 6, wherein the second part includes a bore, the first part includes the oxygen passageway, and the oxygen passageway extends through the bore.

8. A fitting according to claim 6, wherein each of the porous structure and the valve plug define a bore, the first part includes the oxygen passageway, and the oxygen passageway extends through the bore of the porous structure and the bore of the valve plug.

9. A fitting for being mounted to a head of a torch for receiving at least fuel from the head and restricting flashback, the fitting comprising:

a fuel passageway having a fuel inlet proximate a first end of the fitting for receiving fuel from the head, and a fuel outlet for discharging the fuel;

an oxygen passageway having an oxygen inlet proximate the first end of the fitting for receiving oxygen from the head, and an oxygen outlet proximate a second end of the fitting for discharging the oxygen from the fitting;

a porous structure having a multiplicity of convolute passageways extending therethrough, wherein the porous structure is positioned in the fuel passageway to restrict flashback from passing through the fuel passageway; and a valve plug positioned in the fuel passageway for moving from an open position to a closed position in response to reverse flow in the fuel passageway, so as to restrict flashback from passing through the fuel passageway.

10. A fitting for being mounted to a head of a torch for receiving at least fuel from the head and restricting flashback, the fitting comprising:

a fuel passageway having a fuel inlet proximate a first end of the fitting for receiving fuel from the head, and a fuel outlet for discharging the fuel;

a porous structure having a multiplicity of convolute passageways extending therethrough, wherein the porous structure is positioned in the fuel passageway to restrict flashback from passing through the fuel passageway; and a valve plug positioned in the fuel passageway for moving from an open position to a closed position in response to reverse flow in the fuel passageway, so as to restrict flashback from passing through the fuel passageway;

wherein the porous structure is positioned to function as a stop against which the valve plug abuts while the valve plug is in the open position.

11. A fitting according to claim 9, wherein the valve plug includes a pathway, a portion of the valve plug extends completely around the pathway, the pathway is open while the valve plug is in the open position, and the pathway is closed while the valve plug is in the closed position, so as to restrict flashback from passing through the pathway.

12. A fitting according to claim 9, wherein the fitting is an adapter, and a first end of a cutting tip is mounted to the second end of the adapter for receiving oxygen and fuel from the adapter, such that a second end of the cutting tip is for:

discharging the fuel to create a flame for heating a workpiece, and discharging the oxygen to oxidize and thereby cut the heated workpiece.

13. A fitting according to claim 9, wherein the fitting is a cutting tip such that the second end of the cutting tip is for:

discharging the fuel to create a flame for heating a workpiece, and discharging the oxygen to oxidize and thereby cut the heated workpiece.

14. A fitting according to claim 9, wherein the fuel passageway includes an annular space that extends around the oxygen passageway, and the valve plug and the porous structure are both positioned in the annular space.

15. A fitting according to claim 14, wherein the porous structure is positioned to function as a stop against which the valve plug abuts while the valve plug is in the open position.

16. A fitting according to claim 14, wherein the annular space is an annular chamber that is isolated from the oxygen passageway and is positioned between the first and second ends.

17. A fitting according to claim 16, wherein the fuel passageway further includes:

upstream fuel passageways that are positioned around the oxygen passageway, with each upstream fuel passageway being positioned radially distant from the oxygen passageway, and each upstream fuel passageway having an inlet proximate the first end for receiving fuel from the head, and an outlet that is open to the chamber for discharging the fuel into the chamber, and downstream fuel passageways that are positioned around the oxygen passageway, with each downstream fuel passageway being positioned radially distant from the oxygen passageway, and each downstream fuel passageway having an inlet that is open to the chamber for receiving fuel from the chamber, and an outlet proximate the second end for discharging the fuel from the fitting.

18. A cutting torch capable of restricting flashback, comprising:

a head including an interior surface extending around and defining a head cavity, and a fuel port that is open to the head cavity and is for receiving fuel from a fuel supply and supplying fuel to the head cavity; and a fitting including:

a body for being mounted to and unmounted from the head, wherein an end of the body is inserted into the head cavity when mounting the body to the head, the end of the body is withdrawn from the head cavity when unmounting the body from the head, and the body defines a fuel passageway that is in communication with the fuel port for receiving fuel from the fuel port while the body is mounted to the head, and a valve plug and a porous structure fitted relative to the body so that the valve plug and the porous structure restrict flashback from entering the fuel port of the head while the body is mounted to the head, wherein the porous structure is a distinct component from the body and has a multiplicity of convolute passageways extending therethrough, and the porous structure and the valve plug are integrated with the fitting such that the porous structure and the valve plug move with the body when the body is moved from being completely separate from the head to being mounted to the head and when the body is being moved from being mounted to the head to being completely separate from the head; wherein:

the head further includes an oxygen port that is open to the head cavity and is for receiving oxygen from an oxygen supply and supplying oxygen to the head cavity; and the body further defines an oxygen passageway that is in communication with the oxygen port for receiving oxygen from the oxygen port while the body is mounted to the head.

19. A cutting torch according to claim 18, wherein the end of the fitting that is inserted into the head cavity is a first end, the fitting is a cutting tip having a second end that is opposite from the first end, and the second end is for discharging the fuel to create a flame for heating a workpiece, and for discharging the oxygen to oxidize and thereby cut the heated workpiece.

20. A cutting torch according to claim 18, wherein the fitting is an adapter, and wherein the cutting torch further comprises a cutting tip having a first end mounted to the adapter for receiving oxygen and fuel from the adapter, and a second end for discharging the fuel to create a flame for heating a workpiece and for discharging oxygen to oxidize and thereby cut the heated workpiece.

21. A cutting torch according to claim 18, wherein:

the fuel passageway includes:

an annular chamber that extends around and is isolated from the oxygen passageway, upstream fuel passageways that are positioned around the oxygen passageway, with each upstream fuel passageway being positioned radially distant from the oxygen passageway, and each upstream fuel passageway having an inlet proximate the first end for receiving fuel from the head, and an outlet that is open to the chamber for discharging the fuel into the chamber, and downstream fuel passageways that are positioned around the oxygen passageway, with each downstream fuel passageway being positioned radially distant from the oxygen passageway, and each downstream fuel passageway having an inlet that is open to the chamber for receiving fuel from the chamber, and an outlet proximate the second end for discharging the fuel from the fitting; and the valve plug and the porous structure are each annular, positioned in the annular chamber, and extend around the oxygen passageway.

22. A cutting torch according to claim 18, wherein a first part of the body is mounted to a second part of the body and surfaces of the first and second parts together at least partially define a chamber of the fuel passageway that contains the porous structure and the valve plug, the first part of the body includes an upstream portion of the fuel passageway, and the second part of the body includes a downstream portion of the fuel passageway.

23. A cutting torch according to claim 22, wherein the second part of the body includes a bore, the first part of the body includes the oxygen passageway, and the oxygen passageway extends through the bore.

24. A cuffing torch according to claim 22, wherein each of the porous structure and the valve plug define a bore, the first part of the body includes the oxygen passageway, and the oxygen passageway extends through the bore of the porous structure and the bore of the valve plug.

* * * * *